United States Patent [19]

Wetzel, deceased

[11] 4,385,096

[45] May 24, 1983

[54] AQUEOUS MAGNESIUM TREATMENT COMPOSITION FOR METALS

[75] Inventor: Raymond L. Wetzel, deceased, late of Southfield, Mich., by Earlene S. Wetzel, legal representative

[73] Assignee: Occidental Chemical Corporation, Warren, Mich.

[21] Appl. No.: 222,218

[22] Filed: Jan. 2, 1981

[51] Int. Cl.[3] ..... B05D 3/02; B32B 15/04; C09K 3/00; C23F 11/00

[52] U.S. Cl. ..... 428/457; 252/389 A; 252/396; 427/384; 428/532

[58] Field of Search ..... 252/388, 387, 389 R, 252/389 A, 396; 427/388.4, 384; 428/457, 532

[56] References Cited

U.S. PATENT DOCUMENTS 3,260,673 7/1966 Fisher ..... 252/389 X 4,094,801 6/1978 Forsberg ..... 252/389 X

FOREIGN PATENT DOCUMENTS 205701 1/1957 Australia ..... 252/396

*Primary Examiner*—Michael R. Lusignan

*Attorney, Agent, or Firm*—Richard P. Mueller

[57] ABSTRACT

Described is an aqueous base coat composition utilizing magnesium ion preferably in conjunction with at least some compounds from the group hydrofluoric acid, phosphoric acid, tannic acid, and nitric acid and exhibiting a pH of less than 7. The anti-corrosion and adhesive properties of this base coating composition allow it to be further coated with organic film formers, varnishes, lacquers, inks, etc. to form a finished product which is resistant to corrosives, humidity, impact problems, and chipping.

13 Claims, No Drawings

AQUEOUS MAGNESIUM TREATMENT COMPOSITION FOR METALS

DESCRIPTION

Background of the Invention

This invention relates to an aqueous acidic magnesium ion containing composition for treating metal surfaces to inhibit corrosion and improve adhesion of organic coatings. The composition may be characterized as a conversion coating composition.

Metal surfaces, such as iron, galvanized iron, aluminum, etc. are routinely treated both to preserve their useful life and to improve their appearance so as to increase their commercial value. Typically treatment involves cleaning, conversion coating, post treating, drying, and painting (i.e., inking, varnishing, lacquering, and organic coating in general), in separate, discrete steps separated by water rinses. The composition of this invention when used as a conversion coating composition obviates the need for post treatment prior to painting, thereby eliminating both post treatment and the post treatment rinse. The elimination of these steps reduces treatment time, use of chemicals, and loss of chemicals through drag out, while providing a satisfactory coating treatment.

There are two basic conversion coating processes. In the one which is probably not of principal significance for this invention, the acid in the coating composition reacts with the metal to oxidize it in order to form solubilized acid salts. These solubilized acid salts precipitate as the reaction continues and their concentration increases, thereby forming an oxidized metal salt layer on the surface of the metal. Not only is this oxidized layer impervious to further oxidation, but it also serves to protect the metal from oxidation in the future. The second method of conversion coating involves reacting the metal surface with an acid to oxidize and solubilize the metal at the surface. However, with this method the salt that precipitates and deposits on the surface of the metal is not a salt of the original metal but a salt of a different metal such as zinc or manganese which had been present in the applied acid composition. These conversion deposition coatings of oxidized metal salts are also impervious to oxidation and similarly, as in the prior process, protect the metal from further oxidation. Zinc and manganese conversion-deposited coatings generally provide enhanced corrosion resistance and paint bonding relative to the first method because, as the prior art teaches, they provide coatings of greater weight, as per U.S. Pat. No. 3,400,023.

The metal ion used in the conversion coating composition of this invention is magnesium. It is noteworthy that the molecular weight of magnesium is 24.312, while the molecular weight of manganese is 54.938 and zinc 65.37. Moreover, the use of magnesium which, because it is less than half the weight of the other ions known in the art, appears to contradict the teaching of the prior art, provides a satisfactory conversion coating when used as part of an aqueous acid composition. The conversion coating provided by the composition provides corrosion resistance and affords paint adhesion comparable to other conversion coating methods used in the industry. Furthermore, the use of this composition obviates the need to use ionic chromium since the composition's corrosion resistance and adhesion is comparable to that of compositions using ionic chromium. Thereby, the invention provides an alternative to the use of chromium which has caused pollution problems the industry has sought to avoid.

Conversion mechanisms other than the ones described may also take place. For example, tannic acid has been known to form conversion coatings with aluminum and other metals even in the absence of phosphate. It is very likely that the composition of this invention effects a conversion coating by more than one mechanism, even though those mechanisms may not be known.

The present invention employs a chromium free single application paint base composition which closely adheres to the surface of the aluminum metal to protect the metal from corrosion and discoloration while allowing the unpainted metal to retain substantially the color and surface characteristics of a non-processed metal. Furthermore, it provides a paint base for various decorative and protective coatings known in the industry while also providing satisfactory resistance to corrosives, humidity, impact problems, and chipping caused by metal flex.

SUMMARY OF THE INVENTION

The invention relates to a chromium free aqueous composition for treating metal surfaces exhibiting a pH ranging from 2 to less than 7, comprising an effective corrosion inhibiting amount of magnesium ion.

This composition may be applied to a clean metal surface and dried to provide a coating which will serve as a corrosion inhibitor. Further, the dried coating will serve as a base coat for subsequent decorative or protective coatings while increasing their adhesion to the metal surface.

DESCRIPTION OF PREFERRED EMBODIMENTS

Generally, the application will contain a magnesium salt in an aqueous solution in addition to at least one of the following: hydrofluoric acid, phosphoric acid, tannin, or nitric acid. Preferably, the composition will contain all of these constituents.

Although tannin need not be used, it is preferred that from 0.001 to 50 g/l of tannin be employed. However, more preferably, 0.01 to 10 g/l of tannin will be used, and most preferably, from 0.01 to 3 g/l will be utilized. The tannin is added because of its corrosion inhibiting properties and its tendency to provide a more adhesive coating. The tannins, themselves, are widely known for their ability to tan skins by combining with collagen and other protein matter to form leather. Although tannins are known to be gallic acid derivatives, their chemistry is not completely understood. These polyphenolic compounds have molecular weights ranging from 400 to 3000 and may be classified either as hydrolyzable, condensed, or mixed. The hydrolyzable tannins are solubilized by boiling in mineral acids, while the condensed tannins are insoluble under the same conditions. Many of these tannins are found in nature in bark such as wattle, mangrove, oak, eucalyptus, hemlock, pine, larch, and willow; wood such as quebracho, chestnut, oak and urunday, cutch and turkish; fruits, such as myrobalans, valonia, divi-divi, tera and algarrovilla; leaves, such as sumac and gambier; and roots, such as canaigre and palmetto.

The tannins may be further classified as "vegetable tannins" or "mineral tannins." The vegetable tannins are the non-mineral containing organic tannins described above, in contrast to mineral tannins which contain inorganic metals, such as chromium, zirconium and the like. Preferably, the treatment composition of this invention will utilize the vegetable tannins: hydrolyzable, condensed, or mixed.

Magnesium should be added as the salt, preferably, magnesium nitrate $Mg(NO_3)_2.6\ H_2O$. While any effective corrosion inhibiting amount can be used, as little as 0.00095 g/l of magnesium ion may be used and up to 10 g/l. However, preferably, 0.09 to 0.6 g/l will be used.

Although hydrofluoric acid need not be used, if hydrofluoric acid is used, 0.01 to 10 g/l will provide an effective amount. Preferably, however, 0.01 to 5 g/l will be used; and, most preferably, about 0.1 to 1 g/l will be used. The precise mechanisms by which hydrofluoric acid acts forming the conversion in coating of the invention is not known. However, when used with tannin, fluoride tends to enhance the tannin's reaction with aluminum, thereby facilitating at least one of the conversion coating mechanisms of this invention.

Although phosphoric acid need not be used, if it is used, 0.01 to 50 g/l of phosphoric acid affords an effective amount. Preferably, however, 0.1 to 3 g/l will be used. The phosphate forms precipitate with the magnesium as part of the conversion process. Further, it may also form precipitate with the metal ions of the metal to be coated. In any case, it enhances the corrosive resistance and adhesion properties of the conversion coating.

Although nitric acid need not be used, if it is used, then 0.01 to 50 g/l will provide an effective amount. Preferably, however, 1 to 10 g/l nitric acid will be utilized, and, most preferably, 0.05 to 1 g/l. As with the other acids used, the hydrogen ion reacts with the metal to be treated, thereby preparing the surface for conversion coating. The exact interaction of all these chemicals is not known. Nevertheless, the conversion coating yields satisfactory results.

It is to be appreciated that fluoride, phosphate or nitrate ions may be introduced into the compositions through salts of those ions, rather than via the respective acids.

These treatment compositions may be applied by methods known in the art such as immersion, rolling on, spraying, and the like, although the spraying method and roll-on method are preferred. In both these preferred methods, the metal may be at ambient or higher. Generally, if the metal temperature is higher than ambient, it is because of heat transfer during the metal cleaning and rinsing processes. Such heat transfer is not unusual and may typically generate temperatures of above 100° F. Similarly, the composition temperature may be at ambient, but generally exceeds 100° and preferably lies in the range of 120° to 140° F., since higher temperatures may increase chance of volatilization. If volatilization of materials were not a problem, the coating composition temperature could range from ambient to just short of its boiling temperature. Generally, the hotter and more concentrated the composition, the shorter the needed contact time will be.

The contact time will vary with the application. For spray applications of aluminum extrusions a one minute contact time is preferred; whereas, for spray applications on aluminum coils, a 10 second contact time is preferred. With roll-on applications, the contact time is generally of short duration, usually less than 20 seconds, although a contact time of 5 to 30 seconds may be employed. The composition should be acidic. Preferably, the pH will range from 1.5 to 6, and most preferably the pH will range from 2.5 to 4.5.

Other ingredients well known in the art, such as accelerators, chelating agents, coloring agents, stabilizing agents, and the commonly employed metal cations, such as zinc, manganese, cobalt, nickel, iron, and the like, may be added to the composition as long as they do not interfere with the corrosion resistance and adhesion fostering properties of the composition itself.

The following tests have been employed in the examples to evaluate the quality of the treated surface:

Salt Spray Corrosion Resistance

Salt spray corrosion resistance was measured in accordance with the procedure of ASTM B117-61. The panels were rated in terms of the amount of paint loss from a scribe in 1/16 inch increments: N for no loss of paint at any point; F for few blisters; VF for very few blisters. The panels may be further rated in terms of the size of the blisters ranging from 9 for very small size to 1 for very large, with 10 representing no blisters, so that F9 indicates that the blisters are few in number and small in size, as in the humidity corrosion resistance test. The principal numbers represent the general range of the creepage from the scribe along its length whereas the superscripts represent spot or non-representative creepage at the point of maximum creepage along the length of the scribe. Thus, $0\text{-}1^s$ means representative creepage varied from 0/16 to 1/16" with a maximum of 1/16" at one or two spots.

Acetic Acid Salt Spray Resistance

Acetic acid salt spray resistance was measured in accordance with ASTM B287. Conditions are similar to ordinary salt spray testing except the salt solution is adjusted to pH 3.2 with acetic acid and the chamber is maintained at 95° F. Ratings are given as in the Salt Spray Test.

Humidity Corrosion Resistance

Humidity corrosion resistance was measured in accordance with the procedure of ASTM 2247-64T. The panels were rated in terms of the number and size of the blisters, F for few, M for medium, D for dense, VF for very few, and from 9 for very small size to 1 for very large. 10 represents no blisters. Where the rating is preceded by a G or C, the panel gave a 10 rating except for blisters due to handling (G) or concentration effects (C) such as those which would result from solution run down.

Impact

This test is designed to show the effect upon paint adhesion of an impact deformation. A $\frac{5}{8}$ inch diameter tool is impacted on the unpainted side of a panel. The force of the impact is approximately 2000 times the panel thickness (e.g., 50 inch-lbs. for a panel 0.025 inch thick). The standard impact test is performed shortly after the paint is cured and at ambient temperatures. A "Cold Impact" is performed on a painted panel which has been refrigerated to a temperature of 15° F. or less. A "Delayed Cold Impact" is performed on a panel at least 5 days after painting. In any impact test, adhesion is measured by the application and removal of Scotch-brand transparent tape to the deformed surface and the proportion of paint remaining on the surface is rated from 10 (100% adhesion) to 0 (0% adhesion).

Bend Adhesion

The test for paint adhesion is the 180° 0-T bend test. In this test the painted panel is bent 180°. The radius of the bend may be controlled by bending the test panel around a mandrel of predetermined thickness, usually one or more panels of the same thickness as the test panel. The most severe test is where no mandrel is employed and the panel is bent so that the untreated surfaces are touching. This is the so-called 0-T (zero mandrel thickness) bend. Bending around one panel thickness would be a 1-T bend, etc. After bending, the panel is tested for paint adhesion by the application and removal of a standard transparent tape (Scotch #170). The extent of paint removed by the tape is rated 10 for essentially no removal to 0 for complete removal. Values of 9 through 1 are assigned for intermediate adherence ratings in proportion to % paint adherence to the substrate.

Having now described the invention broadly, stated below is further amplification of the invention wherein all temperature is in degrees centigrade and all parts are parts by weight (PBW).

EXAMPLES

Control A

The working examples each utilize Control A. Typically, the panel to be treated is cleaned with detergent, water rinsed, and conversion coated with Type A treatment, dried in an oven and then painted. The Type A treatment is a working bath consisting of 0.34% $CrO_3$, 0.36% Aerosil 200, 0.23% of 75% $H_3PO_4$, with the remainder of the working bath being water. The Type A treatment is rolled on.

Control B

The working examples each utilize Control B. Typically, the panel to be treated is cleaned with detergent, water rinsed, and conversion coated with Type B treatment, rinsed, dried in an oven and then painted. The Type B treatment is a working bath consisting of 0.31% $CrO_3$, 0.06% $H_3PO_3$, 0.025% of 70% HF, with the remainder of the working bath being water. This Type B treatment is sprayed on.

Example 1

In each of the following cases presented by this example, the constituents indicated are mixed and made into a 6 liter bath which is applied to a clean and rinsed aluminum panel with a spray technique. The treated panels are dried and painted without intermediate rinsing.

All the panels in this first example were then painted with an acrylic paint produced by PPG Industries, Inc. designated PPG 1-LW-10294. See Table I.

Example 2

In each of the following cases presented by this example, the constituents indicated are mixed and made into a 6 liter bath which is applied to a clean and rinsed aluminum panel with a spray technique. The treated panels are dried and painted without intermediate rinsing.

The paint utilized in this example is an alkyd resin produced and provided by DuPont designated DULUX 704. See Table II.

Example 3

In each of the following cases presented by this example, the constituents indicated are mixed and made into a 6 liter bath which is applied to a clean and rinsed aluminum panel with a spray technique. The treated panels are dried and painted without intermediate rinsing.

The paint utilized in this example is a polyester base paint produced by Bradley Vrooman designated Bradley Vrooman 1401. See Table III.

TABLE I

| Sample No. | $Mg^{++}$ | Mls 10% HF | Mls 10% $H_3PO_4$ | 0.62% Chestnut Tannin Extract | Mls 10% $HNO_3$ | Salt Spray 672 hours | Acetic Acid Salt Spray 504 hours | Humidity 1008 hrs. | Room Temp. Impact | Cold Impact | 0/T Bend | 2/T Bend |
|---|---|---|---|---|---|---|---|---|---|---|---|---|
| (1) | 3.00 | 7.0 | 7.5 | 14.0 | 7.0 | 0–1 F8 | $0–1^{2s}$ VF8 | 10 | 9 | 7 | 5 | 9 |
| (2) | .60 | 7.0 | 7.5 | 14.0 | 14.0 | 0–2 VF9 1% P | $0–1^{s}$ VF6 | 10 | 8 | 8 | 8 | 9 |
| (3) | 2.96 | 7.0 | 7.5 | 14.0 | 14.0 | $0–1^{s}$ VF9 1% P | $0–1^{s}$ F6 | G8 | 8 | 8 | 6 | 10 |
| | Control B | | | | | N | N | 10 | 6 | 6 | 1 | 7 |
| | Control A | | | | | N | $0–1^{s}$ | 10 | 1 | 1 | 0 | 4 |

TABLE II

| Sample No. | $Mg^{++}$ | Mls 10% HF | Mls 10% $H_3PO_4$ | 0.62% Chestnut Tannin Extract | Mls 10% $HNO_3$ | Salt Spray 984 hours | Acetic Acid Salt Spray 504 hours | Humidity 672 hrs. | Room Temp. Impact | Cold Impact | 0/T Bend | 2/T Bend |
|---|---|---|---|---|---|---|---|---|---|---|---|---|
| (1) | 3.00 | 7.0 | 7.5 | 14.0 | 7.0 | $0–1^{s}$ | $0–1^{2s}$ | D9 | 10 | 10 | 6 | 9 |
| (2) | .60 | 7.0 | 7.5 | 14.0 | 14.0 | $0–1^{s}$ | $0–1^{3s}$ | D9 | 9 | 9 | 4 | 9 |
| (3) | 2.96 | 7.0 | 7.5 | 14.0 | 14.0 | N | $0–1^{3s}$ | D9 | 10 | 10 | 2 | 9 |
| | Control B | | | | | N | $0–1^{s}$ | D9 | | | | |
| | Control A | | | | | VF9 | $0–1^{s}$ | D9 | 8 | 0 | 0 | 0 |

TABLE III

| Sample No. | $Mg^{++}$ | Mls 10% HF | Mls 10% $H_3PO_4$ | 0.62% Chestnut Tannin Extract | Mls 10% $HNO_3$ | Salt Spray 1008 hours | Acetic Acid Salt Spray 504 hours | Humidity 1008 hrs. | Room Temp. Impact | Cold Impact | 0/T Bend | 2/T Bend |
|---|---|---|---|---|---|---|---|---|---|---|---|---|
| (1) | 3.00 | 7.0 | 7.5 | 14.0 | 7.0 | $0-1^S$ | $0-1^S$ | G9 | 8 | 9 | 8 | 10 |
| (2) | .60 | 7.0 | 7.5 | 14.0 | 14.0 | N | N | 10 | 10 | 7 | 10 | 10 |
| (3) | 2.96 | 7.0 | 7.5 | 14.0 | 14.0 | N | VF8 | 10 | 8 | 9 | 8 | 9 |
| | Control B | | | | | N | $0-1^S$ | VF9 | 6 | 5 | 0 | 7 |
| | Control A | | | | | N | $0-1^S$ | VF9 | 6 | 7 | 2 | 9 |

I claim:

1. An aqueous, acidic, chrome-free composition for treating metallic surfaces which contains conversion coating forming components comprising magnesium ions, tannin, and phosphoric acid, wherein each of said conversion coating components are present in an amount which, in combination with the other such components, is sufficient to form a corrosion resistant conversion coating on the metal surface treated.

2. The composition as claimed in claim 1 wherein the conversion coating forming components also include at least one additional component selected from nitric acid and hydrofluoric acid.

3. The composition as claimed in claim 2 wherein the conversion coating forming components include nitric acid and hydrofluoric acid.

4. The composition of claim 2:

(a) wherein the magnesium ion concentration is at least 0.00095 g/l; and (b) wherein each compound from the group consisting of phosphoric acid, nitric acid, hydrofluoric acid and tannin is present in a concentration of at least 0.01 g/l.

5. The composition of claim 3:

(a) wherein the magnesium ion concentration ranges from 0.095 g/l to 10 g/l;

(b) wherein the phosphoric acid concentration ranges from 0.05 to 3 g/l;

(c) wherein the nitric acid concentration ranges from 0.05 to 2 g/l;

(d) wherein the hydrofluoric acid concentration ranges from 0.05 to 3 g/l; and (e) wherein the tannin concentration ranges from 0.01 to 3 g/l.

6. The composition of claim 4 wherein the concentration of (a) magnesium ion and (b)each member of the group consisting of phosphoric acid, nitric acid, hydrofluoric acid, and tannin, vary within the range of 0.01 to 50 g/l.

7. A process for treating a metal surface comprising the steps of:

(a) coating the surface with the composition of claim 1; and (b) thereafter drying the composition on the coated surface.

8. The process as claimed in claim 7 wherein the conversion coating forming components in the composition also include at least one additional component selected from nitric acid and hydrofluoric acid.

9. The process as claimed in claim 8 wherein the conversion coating forming components in the composition include nitric acid and hydrofluoric acid.

10. The process as claimed in claim 9 wherein:

(a) the magnesium ion concentration ranges from 0.00095 to 10 g/l;

(b) the phosphoric acid concentration ranges from 0.01 to 50 g/l;

(c) the nitric acid concentration ranges from 0.01 to 50 g/l;

(d) the hydrofluoric acid concentration ranges from 0.01 to 10 g/l; and (e) the tannin concentration ranges from 0.001 to 50 g/l.

11. A metal surface having thereon a corrosion resistant conversion coating formed by the process of claim 7.

12. The process of claim 10 wherein:

(a) the magnesium ion concentration ranges from 0.01 to 10 g/l;

(b) the phosphoric acid concentration ranges from 0.05 to 3 g/l;

(c) the nitric acid concentration ranges from 0.05 to 1 g/l;

(d) the hydrofluoric acid concentration ranges from 0.01 to 5 g/l; and (e) the tannin concentration ranges from 0.01 to 10 g/l.

13. The process of claim 8 wherein:

(a) the magnesium ion concentration is at least 0.00095 g/l; and (b) each compound from the group consisting of phosphoric acid, nitric acid, hydrofluoric acid and tannin is present in a concentration of at least 0.01 g/l.

* * * * *